United States Patent [19]
Maes et al.
[11] 4,456,494
[45] Jun. 26, 1984

[54] SYSTEM FOR MAKING AN AQUEOUS SLURRY-TYPE BLASTING COMPOSITION

[75] Inventors: Michel E. Maes, King County, Wash.; Robert L. Shaw, Dallas County, Tex.; Royal L. Reinsch, King County, Wash.

[73] Assignee: Energy Sciences Partners, Ltd., Seattle, Wash.

[21] Appl. No.: 404,764

[22] Filed: Aug. 3, 1982

Related U.S. Application Data

[63] Continuation-in-part of Ser. No. 154,381, May 29, 1980.

[51] Int. Cl.³ ..... C06B 45/02
[52] U.S. Cl. ..... 149/21; 149/43; 149/109.6; 264/3 C
[58] Field of Search ..... 149/21, 43, 109.6; 264/3 C

[56] References Cited

U.S. PATENT DOCUMENTS

| | | | |
|---|---|---|---|
| 3,121,036 | 2/1964 | Cook et al. | 149/41 |
| 4,032,375 | 6/1977 | Wasson | 149/44 |
| 4,097,316 | 6/1978 | Mullay | 149/2 |
| 4,104,092 | 8/1978 | Mullay | 149/2 |
| 4,111,727 | 9/1978 | Clay | 149/2 |
| 4,130,449 | 12/1978 | Craig | 149/62 |
| 4,140,561 | 2/1979 | Keith | 149/2 |
| 4,198,253 | 4/1980 | Kirchnerova | 149/44 |
| 4,207,125 | 6/1980 | Grant | 149/44 |
| 4,216,040 | 8/1980 | Sudweeks | 149/21 |
| 4,221,616 | 9/1980 | McLean | 149/62 X |

*Primary Examiner*—Stephen J. Lechert, Jr.
*Attorney, Agent, or Firm*—Seed and Berry

[57] ABSTRACT

A blasting composition, method, and system for making such is disclosed. The blasting composition consists essentially of a particulate inorganic nitrate oxidizer, a particulate metal fuel, water, and a gelling agent. The composition is prepared by blending 10–20% by weight of the total amount of water to be added to the composition, with the particulate inorganic nitrate oxidizer; adding a dry blend of gelling agent and particulate metal fuel to the damp oxidizer; briefly mixing the two components; adding the remainder of the water; and slowly subjecting the mixture to a tumbling action for a brief period of time sufficient to obtain a uniform composition.

8 Claims, 1 Drawing Figure

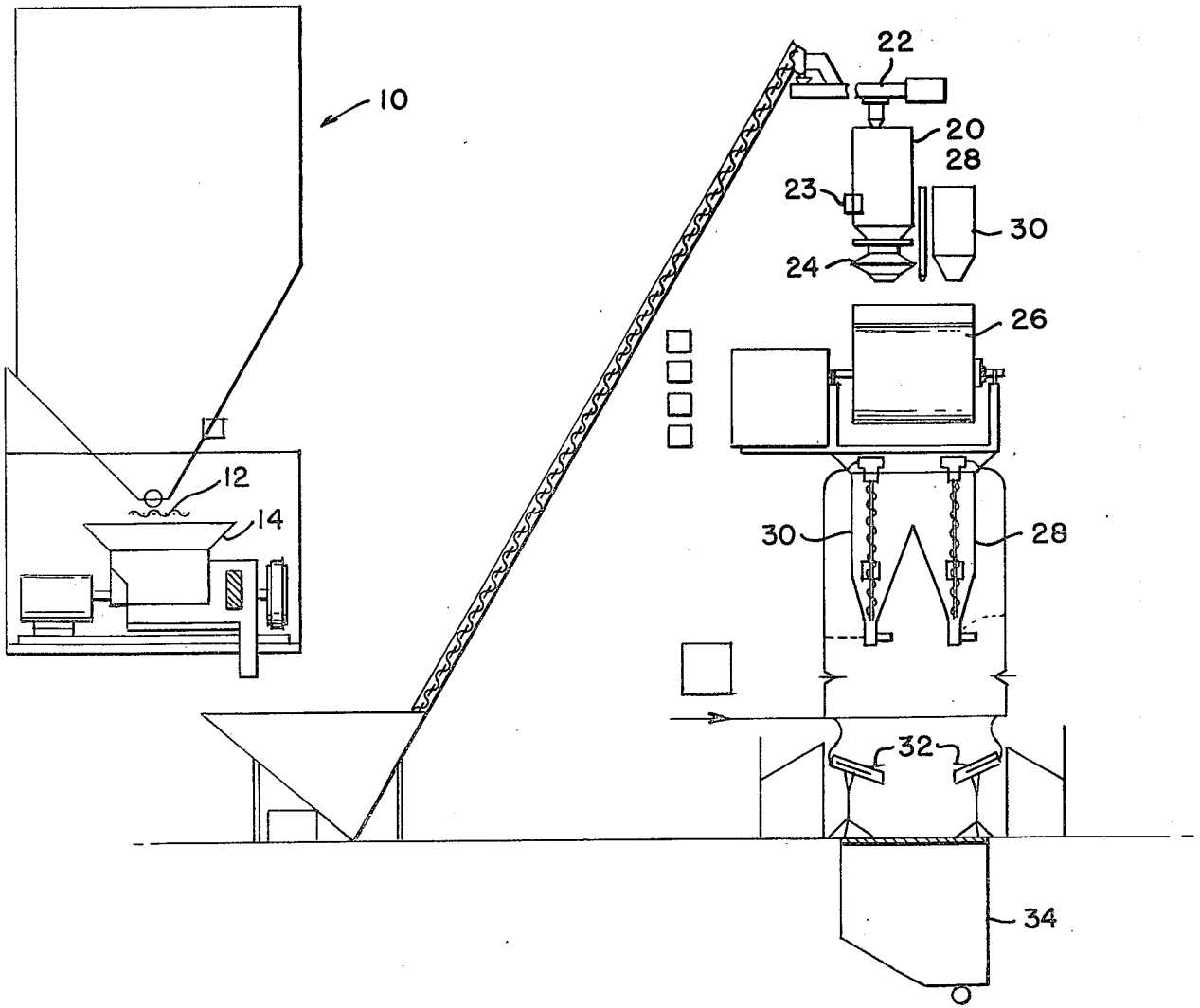
10
12
14
22
20
28
23
24
30
26
28
30
32
34 weight percent of a cross-linking agent, and 15–35% water.

BRIEF DESCRIPTION OF THE DRAWING

The drawing illustrates a schematic diagram of a mixing system for formulation of the aqueous, slurry-type blasting composition of the type disclosed herein.

BEST MODE FOR CARRYING OUT THE INVENTION

The inorganic nitrate which is preferably employed as the nitrate component of the explosive composition of this invention is ammonium nitrate; however, other inorganic nitrates can be employed alone or in admixture with the ammonium nitrate, such as the alkali or alkaline earth metal nitrates; e.g., sodium nitrate, potassium nitrate, calcium nitrate. If a mixture is used, it should generally contain a predominant amount of ammonium nitrate in preference to the other nitrates. The nitrate used can be in any form; i.e., crushed, prill or a combination of the two, reasonably oil- and water-free. Fertilizer-grade ammonium nitrate is suitable. The particulate nitrate is usually processed through a hammermill or other means to grind it to a uniform particulate size before being blended with the other components in the explosive composition.

The dry or second component of the explosive composition is comprised of a finely divided fuel, preferably aluminum, which is blended dry with a gelling or thickening agent, such as guar gum, starches, or synthetic polymers, such as the polyacrylamides. Preferred is de-dusted aluminum flake which includes a coating of a polyfluorocarbon and/or a metal stearate to prevent reaction with water. Alcoa 1651, manufactured by the Aluminum Company of America, is a suitable material, although other commercially available aluminum flake products may be used. The particulate aluminum is susceptible to dusting, particularly if disturbed by vibration. Particulate aluminum is extremely hazardous to use if dusting cannot be avoided during mixing of the explosive composition. It was found that dry blending of the gelling agent with the powdered aluminum resulted in the aluminum picking up the gelling agent on its surface. Guar gum is preferred as the gelling agent, the guar gum preferably mixed with a cross-linking agent, such as a metal salt (i.e., ferric nitrate, sodium dichromate), ammonium salts, antimony salts, etc.

For preparation of the blasting composition, about 10–20% by weight of the total amount of water to be used in the explosive composition is initially blended with the total amount of particulate nitrate oxidizer, such as ammonium nitrate. This water is blended thoroughly with the dry particulate oxidizer to form a damp mass. The dry blend of the gelling agent/cross-linking agent/powdered metal is then added to the damp particulate oxidizer and the two blended for a brief period of time before the remaining water is added to the mixture while the mixture is being subjected to a slow tumbling action for a brief period of time. The overall mixing time is generally one minute or less.

It was noted that when a dry mixture of powdered aluminum and guar gum contacts water, the guar gum immediately attaches to the water molecules and carries the powdered aluminum with it. If guar gum is added to water by itself, it forms clumps. If powdered aluminum is added to water by itself, it floats and refuses to be absorbed. The dry mixture of aluminum and guar gum, however, mixes well with particulate ammonium nitrate or other particulate nitrate oxidizer to which water has been added. The key to avoiding dusting of the aluminum appears to be in making the powdered aluminum sticky to water, and at the same time, dispersing the gelling agent so that no clumping occurs in the composition.

The dry blend of gelling agent/cross-linking agent/-powdered metal may be blended off-site and packaged for blending with the particulate oxidizer at the use site. At the use site, the particulate oxidizer is blended with an initial amount of water, to which the dry blend of particulate metal/gelling agent/cross-linking agent is added with additional water to produce an aqueous, slurry-type blasting composition which can be used with safety.

Reference is made to the drawing illustrating a schematic of equipment which may be used for blending the explosive composition. The particulate ammonium nitrate or other inorganic nitrate or mixture thereof is delivered into a bin 10 from a bulk facility holding the particulate nitrate. The particulate nitrate, after passing through a sieve 12, drops into a hammer mill 14, which grinds the inorganic oxidizer to a uniform particle size. The ground inorganic nitrate exits from the hammer mill into a bin 16, where it is conveyed by auger 18 to bin 20. Bin 20 incorporates a vibrator 22 for feeding the particulate oxidizer to a scale 24, which weighs out the appropriate amount of oxidizer used for blending a batch of the explosive composition. The weighed amount of dry particulate oxidizer drops by gravity into a mixer 26. The mixer is similar to a conventional mortar mixer and includes paddles (not shown) therein for mixing of the explosive composition. An initial measured amount of water, totalling 10–20% by weight of the total amount of water to be added to the composition, is mixed with the dry particulate nitrate in the mixer 26. The water is delivered through water pipe 28. After blending of the water with the particulate nitrate for a short period of time, generally less than 30 seconds, the dry blend of gelling agent/cross-linking agent/powdered metal is added to the mixture in the mixer and is slowly tumbled for uniform blending for a time less than about 30 seconds. The remaining water for the composition is then added to the mixer from water tank 30 and the mixture is then again blended for a time less than about one minute. The mixer 26 is activated to slowly tumble the mixture for a short period of time. If the mixture is mixed too rapidly, the sensitivity of the composition is destroyed. If mixed too slowly, a nonuniform composition is obtained. Also, if mixed too rapidly, dusting of the powdered metal will occur. After a short mixing time, the mixture, having a molasses-like consistency, is dumped into twin auger packers 28 and 30, which pack the composition in polyethylene or other plastic packages or cartridges (not shown). The product packages are dropped onto tipper ties 32, which direct the cartridges into a holding vessel 34. The mixer 26 may be provided with an interlock mechanism which prevents mixing of the composition until the proper amounts of the two components have been added to the mixer.

The mixed explosive composition consists essentially of 50–80% by weight ammonium nitrate or other inorganic nitrate or mixtures thereof, 0–10% by weight particulate aluminum, preferably 1–4% by weight, 15–35% by weight water, 0.5–10% by weight gelling agent, and 0.02–0.5% by weight cross-linking agent.

SYSTEM FOR MAKING AN AQUEOUS SLURRY-TYPE BLASTING COMPOSITION

DESCRIPTION

REFERENCE TO RELATED APPLICATION

This application is a continuation-in-part of U.S. patent application Ser. No. 154,381, filed May 29, 1980.

TECHNICAL FIELD

Aqueous and oil-based inorganic nitrate slurry explosives are extensively used in strip mining of coal and other construction uses. These slurry-type explosives generally contain a major amount of an inorganic nitrate and a fuel together with water or oil and a thickening or gelatinizing agent. The most common way of making slurry-type explosive compositions has generally involved employing an aqueous solution of ammonium nitrate or alkali or alkaline earth metal nitrates to which the other components are added. Finely divided aluminum flakes are commonly used in such compositions; however, "dusting" of this particulate material during manufacture of blasting compositions presents an extreme safety hazard. It is also difficult to obtain a homogeneous mix of the metal nitrate and metal particles without segregation. If the components are not uniformly mixed, the explosive composition either does not detonate or performs unsatisfactorily.

It has remained a problem to develop a slurry-type explosive composition which can be manufactured quickly, without the need for special equipment, at reasonable cost, and with safety.

The following U.S. patents disclose slurry-type blasting compositions and methods of making them; however, none of them employ a method or composition as described and claimed herein.

U.S. Pat. No. 3,294,601 discloses a slurry-type blasting composition of ammonium nitrate as an oxidizer, hexamethylenetetramine as a fuel, water, and a thickening or gelling agent. No particulate metal as a fuel is employed. The blasting composition is formed by mixing the ammonium nitrate, gelling agent together in a steam-jacketed vessel to melt them and slowly adding to the dry, hot melted mixture hexamethylenetetamine dissolved in boiling water, the mixture being blended until a cohesive mass is formed.

U.S. Pat. No. 3,765,967 discloses a slurry explosive prepared by dissolving an inorganic metal perchlorate in water together with a thickener and particulate pentaerythritol tetranitrate and adding finely divided aluminum to the aqueous slurry.

U.S. Pat. No. 3,985,593 discloses a method of making a slurry explosive by solubilizing nitromethane in an aqueous gel of sodium perchlorate which includes a solubilizing agent for the nitromethane, such as ethylene glycol.

U.S. Pat. No. 3,787,254 discloses a water-based slurry composition made by distributing a liquid hydrocarbon fuel in an emulsion-like form of a mixture of ammonium nitrate and calcium nitrate, and then adding a thickening or gelling agent. Aluminum metal is added as a secondary fuel for certain of the compositions.

U.S. Pat. No. 3,886,010 discloses a water-based slurry composition made by incorporating a small amount of a thickener to an aqueous oxidizing solution of ammonium nitrate and thereafter adding a dry mix of a particulate solid fuel, such as finely divided aluminum, to the solution by stirring and mixing, the dry mix including a supplemental thickening agent and a cross-linking agent.

U.S. Pat. No. 3,378,415 discloses an explosive slurry made by melting together the liquefiable component of the composition, i.e., ammonium nitrate and sodium nitrate, and then mixing in a dough-type mixer the mixture of the metal nitrates and a carbonaceous fuel, such as starch or woodmeal; a particulate metal, such as aluminum powder or flake; water; and a thickening agent, if needed. It is essential to melt the liquefiable ingredients first and then add the fuel and other ingredients to avoid spontaneous ignition thereof.

U.S. Pat. No. 3,235,425 discloses a sequence of steps for mixing a slurry-type blasting composition by mixing together a dry mixture of ammonium nitrate and a gelling agent, then adding the resulting dry mix to water, and thereafter mixing in a smokeless powder.

U.S. Pat. No. 3,135,606 discloses a thickened, water-bearing blasting composition wherein the solid components of the explosive composition (flake aluminum powder, guar gum and powdered coal) are dispersed in a thickened, substantially saturated aqueous solution of ammonium nitrate and sodium nitrate. Alternatively, the patent teaches mixing all of the solid components together, adding water to the mixture, and agitating the mixture until the solids are uniformly dispersed and sufficient thickening occurs to hold the solids in suspension.

U.S. Pat. No. 3,160,538 discloses a pourable, substantially water-resistant explosive gel formed by mixing together ammonium nitrate, hydrochloric acid, powdered metal and water with guar gum and glutaraldehyde.

None of the patents disclose a sequence of mixing steps to avoid dusting of particulate metal fuel (such as aluminum) in the production of blasting compositions nor a method which avoids densensitizing the composition during manufacture.

DISCLOSURE OF INVENTION

It is an object of this invention to provide a method of formulating a homogeneous, aqueous, slurry-type blasting composition using flaked aluminum, with little or no dusting of the aluminum.

The components of the blasting composition can be separately packaged and mixed together quickly and safely without the need for sophisticated equipment and without desensitizing the blasting composition. The blasting composition employs no toxic ingredients and can be handled in an open plant.

The blasting composition is prepared by blending 10–20% by weight of the total amount of water to be used in the blasting composition with the total amount of particulate nitrate oxidizer. To this damp particulate nitrate oxidizer is added a dry blend of a gelling agent and powdered metal. The dry blend and damp particulate oxidizer are blended together for a brief period of time. To this blend is then added the remaining water for the composition while subjecting the composition to a slow tumbling action for a brief period of time. The overall mixing time is generally one minute or less. The blasting composition consists essentially of 50–80% by weight ammonium nitrate, 0.5–10% by weight powdered metal, preferably flake aluminum in an amount ranging from 1–4% by weight, 0.5–10% by weight gelling agent, preferably 1–2% by weight, 0.02–0.5

The equipment needed to formulate the explosive composition is not sophisticated. The components, particularly the aluminum-containing component, can be packaged in dry form for transport to the use site. The ammonium nitrate or other inorganic nitrate can be acquired from any suitable source and the blasting composition formulated quickly with no dusting or safety problems. No other fuel than the relatively small amount of particulate powdered metal is needed. A relatively high proportion of water is used in contrast to other commercially available, slurry-type explosive compositions. The aluminum content may be varied to vary the sensitivity of the explosive composition. Above about 3% by weight aluminum, the explosive composition is cap sensitive, whereas below about 3% by weight aluminum, a booster may be necessary.

EXAMPLE 1

Two batches of a blasting composition were prepared in 15-lb amounts. Guar gum, 0.228 lb, was added to 0.531 lb of finely divided aluminum powder coated with a thin coating of polytetrafluoroethylene (Alcoa 1651, manufactured by The Aluminum Company of America). About 0.57 lb water was added to 10.45 lbs agricultural-grade ammonium nitrate. The water was blended with the ammonium nitrate to form a damp mixture thereof. The dry blend of guar gum and powdered aluminum was the added to the damp ammonium nitrate, and 2.23 lbs of additional water was added while the composition was slowly subjected to tumbling. The resulting composition, containing 69.6% ammonium nitrate, 25.3% water, 1.5% guar gum, and 3.5% powdered aluminum, all by weight, was packed into 4-inch diameter polyethylene tubes. Twenty-seven hours after the manufacture of the composition, the composition was detonated in a steel pipe 5 inches in internal diameter.

An additional 15 lbs of explosive composition were prepared as described previously. The two compositions were place in 5-inch steel pipes and detonated, and compared to a commercially available TNT plus ammonium nitrate formulation under the tradename "Nitroman":

| Composition | Time Interval* | Velocity** |
|---|---|---|
| TNT plus AN (Nitroman) (confined) | 38 | 5250 |
| Sample 1 (confined) | 48 | 4150 |
| Sample 2 (unconfined) | 49 | 4080 |

*The time interval equals the number of seconds $\times 10^{-6}$ it took for the detonation wave to travel 20 cm.
**Velocity equals the rate of detonation in meters/second.

EXAMPLE 2

3.49 lbs of guar gum was mixed dry with 1.06 lbs of powdered aluminum (Alcoa 1651). 1.14 lbs water was mixed with 20.90 lbs agricultural-grade ammonium nitrate and the mixture blended to produce a damp ammonium nitrate. The dry guar gum/powdered metal mixture was added to the damp ammonium nitrate and, thereafter, an additional 6.46 lbs water added. The composition was slowly subjected to mixing in a laboratory mixer of the type described in the application for less than one minute. The composition was packaged in 4-inch polyethylene tubes and placed in 5-inch steel tubes for detonation testing. The results were as follows:

| Composition | Time Interval* | Velocity** |
|---|---|---|
| Sample of Ex. 2 (unconfined) | 52 | 3850 |

We claim:

1. A method for making a homogeneous, aqueous slurry-type blasting composition containing a particulate inorganic nitrate oxidizer and a particulate metal fuel, comprising:
   - blending a particulate gelling agent together with a finely divided powdered metal to form a dry mixture thereof;
   - blending 10–20% by weight of the total amount of water to be used in the composition with the particulate inorganic nitrate oxidizer;
   - adding the dry blend of gelling agent and powdered metal to the damp, particulate, inorganic nitrate oxidizer;
   - blending the damp inorganic oxidizer and powdered metal/gelling agent together for a brief period of time; and
   - adding the remaining water to the composition while slowly subjecting the mixture to tumbling for a time sufficient to obtain a uniform composition.

2. The method of claim 1 wherein the composition consists essentially of 50–80% by weight particulate inorganic nitrate, 0.5–10% by weight finely divided aluminum flake, 0.5–10% by weight gelling agent, and 15–35% by weight water.

3. The method of claim 2 wherein the mixing time after addition of the remaining water ranges from 2–30 seconds and the inorganic nitrate is ammonium nitrate.

4. The method of claim 2 wherein the gelling agent is guar gum.

5. The method of claim 2 wherein a cross-linking agent is included with the gelling agent in an amount ranging from 0.02–0.5% by weight.

6. A system for making a homogeneous, aqueous, slurry-type blasting composition which contains a particulate nitrate oxidizer, a finely divided metal fuel, and a gelling agent, comprising:
   - grinding means for grinding the particulate nitrate to a uniform particle size;
   - means for feeding the particulate oxidizer in weighed amounts to a mixer having tumbling blades therein which subject the material in the mixture to a slow tumbling action;
   - means for feeding a measured amount of water into the mixer containing the particulate oxidizer prior to addition of a dry mixture of gelling agent and powdered metal, and after addition of the gelling agent and powdered metal; and
   - means for packing the blended explosive composition in cartridges.

7. The system of claim 6 wherein the composition consists essentially of 50–80% by weight particulate nitrate oxidizer, 1–4% by weight finely divided aluminum, 15–35% by weight water, and 0.5–10% by weight gelling agent.

8. The system of claim 6 wherein the means for packing is an auger packer.

* * * * *